US006145795A

United States Patent [19]

McAdam et al.

[11] Patent Number: 6,145,795

[45] Date of Patent: Nov. 14, 2000

[54] PUMPKIN STAND

[75] Inventors: John J. McAdam, Reading; Emerson M. Reyner, II, Palmyra, both of Pa.

[73] Assignee: Sheerlund Products, Inc., Reading, Pa.

[21] Appl. No.: 09/258,223

[22] Filed: Feb. 26, 1999

[51] Int. Cl.[7] ..... A47G 23/02

[52] U.S. Cl. ..... 248/146; 248/346.11; 248/519; 47/40.5

[58] Field of Search ..... 248/146, 152, 248/314, 346.11, 519; 47/40.5

[56] References Cited

U.S. PATENT DOCUMENTS

| | | | |
|---|---|---|---|
| 348,671 | 9/1886 | Haehnlen . | |
| 1,471,122 | 10/1923 | Greaves . | |
| 2,102,542 | 12/1937 | Markle, Jr. | 65/15 |
| 2,206,694 | 7/1940 | Greene | 47/38 |
| 2,257,970 | 10/1941 | Long | 65/15 |
| 2,781,651 | 2/1957 | Cutler | 65/53 |
| 2,924,330 | 2/1960 | Ballard | 206/46 |
| 2,928,537 | 3/1960 | Stagner | 206/46 |
| 2,932,119 | 4/1960 | Borah | 45/28 |
| 3,183,545 | 5/1965 | Bergstrom | 16/42 |
| 3,451,328 | 6/1969 | Swett | 47/2 |
| 3,912,249 | 10/1975 | Vaca | 269/54.5 |
| 4,576,140 | 3/1986 | Schlosser | 126/25 R |
| 4,759,524 | 7/1988 | Anderson | 248/346.1 |
| 5,221,069 | 6/1993 | Struthers et al. | 248/231.9 |
| 5,353,926 | 10/1994 | Yeh | 206/217 |

*Primary Examiner*—Ramon O. Ramirez
*Assistant Examiner*—Walter Landry
*Attorney, Agent, or Firm*—Howson and Howson

[57] ABSTRACT

A stand intended to protect an underlying surface from juices discharging from a pumpkin, while providing pedestals for the support and display of the pumpkin.

9 Claims, 2 Drawing Sheets

PUMPKIN STAND

FIELD OF THE INVENTION

The present invention relates to stands for supporting and displaying objects, more particularly, the present invention relates to a stand for the support and display of a carved or uncarved pumpkin.

BACKGROUND OF THE INVENTION

Heretofore, a carved pumpkin or jack-o-lantern has generally been placed for display on a surface such as an outdoor porch or patio or an indoor windowsill. Carving often takes place on an indoor table. Fluids that leak from a carved or uncarved pumpkin can often stain such underlying surfaces, and pumpkin juice stains are difficult to remove.

Several devices for supporting items of produce have been disclosed in the patented prior art. For instance, U.S. Pat. No. 2,257,970 to Long discloses a support structure that includes a reservoir intended to protect a person from the juice of a watermelon while it is being eaten in an automobile.

U.S. Pat. No. 2,928,537 to Stagner discloses a support for an apple for packaging and handling. This support provides a pedestal with spikes for securing the apple upright inside a cube-like box.

While the patented devices may function satisfactorily for their intended purposes, there is a need for a device that securely holds a pumpkin above a shallow reservoir while being carved, and that protects underlying surfaces from the pumpkin's juices, during and after carving (or if left uncarved). There is also a need for a device that stabilizes and displays a carved or uncarved pumpkin both inside and outside the home.

OBJECTS OF THE PRESENT INVENTION

With the foregoing in mind, a primary object of the present invention is to provide a novel device for displaying a carved or uncarved pumpkin either inside or outside the home.

A second object of the present invention is to provide a stable base for supporting a pumpkin during carving.

A third object of the present invention is to provide a stable base for supporting a carved or uncarved pumpkin during display.

A fourth object of the present invention is to provide a pumpkin support that affords complete ventilation of the pumpkin while on display.

A fifth object of the present invention is to provide protection for the surface beneath a carved or uncarved pumpkin (such as a floor, rug or table) from fluids discharged from the pumpkin during carving or display.

A sixth object of the present invention is to provide a device for elevating the pumpkin to promote air circulation in order to retard decay, and to keep the pumpkin bottom away from any discharged juices that might accelerate disintegration.

SUMMARY OF THE INVENTION

The present invention provides a stand for use in carving and displaying a pumpkin. The stand comprises a plurality of pedestals projecting upwardly from a dish. Each pedestal has a chamfered surface and at least one pin projecting upwardly for the purpose of engaging and positioning a pumpkin so as to preclude any movement relative to the dish, and for the purpose of elevating the pumpkin above the bottom of the dish. The dish has a substantially circular shape with an upturned flange at its perimeter to form a receptacle for containing fluids discharged from the pumpkin during carving and afterward. The pedestals and dish may be either integrally molded, or not.

BRIEF DESCRIPTION OF THE DRAWINGS

The foregoing and other objects, features and advantages of the present invention should become apparent from the following description when taken in conjunction with the accompanying drawing in which.

DESCRIPTION OF THE PREFERRED EMBODIMENT

Figure 3:
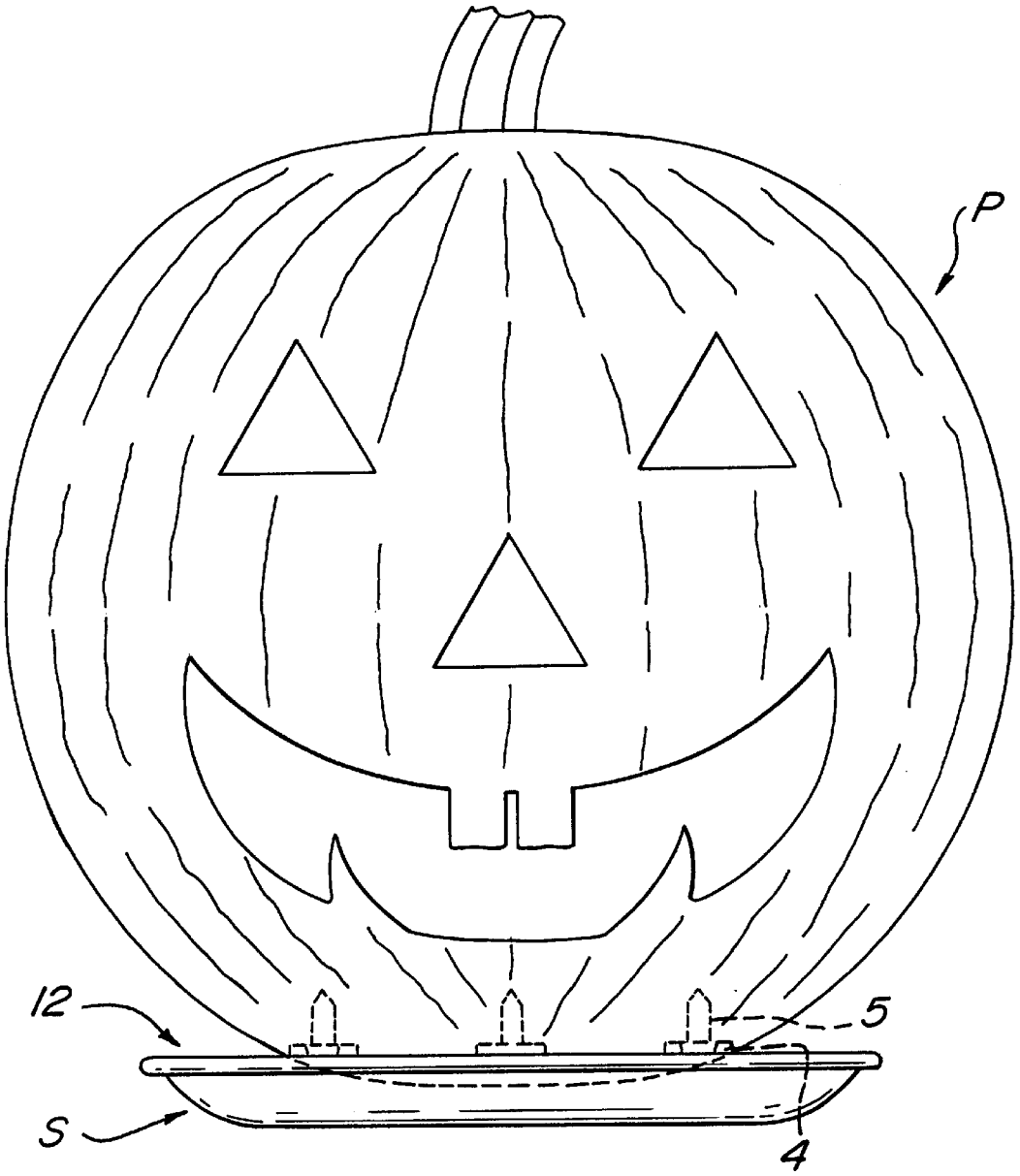
FIG. 3 is an elevational view of the stand while performing its intended function, of displaying a carved pumpkin P.

As best seen in FIG. 3, the present invention provides a stand S intended for display, support and preservation of a pumpkin P as well as for protection of underlying surfaces from any liquids discharged from the pumpkin during carving and subsequent display. In addition the stand S collects any rain or condensate that collects on the outside of the pumpkin.

Figure 1:
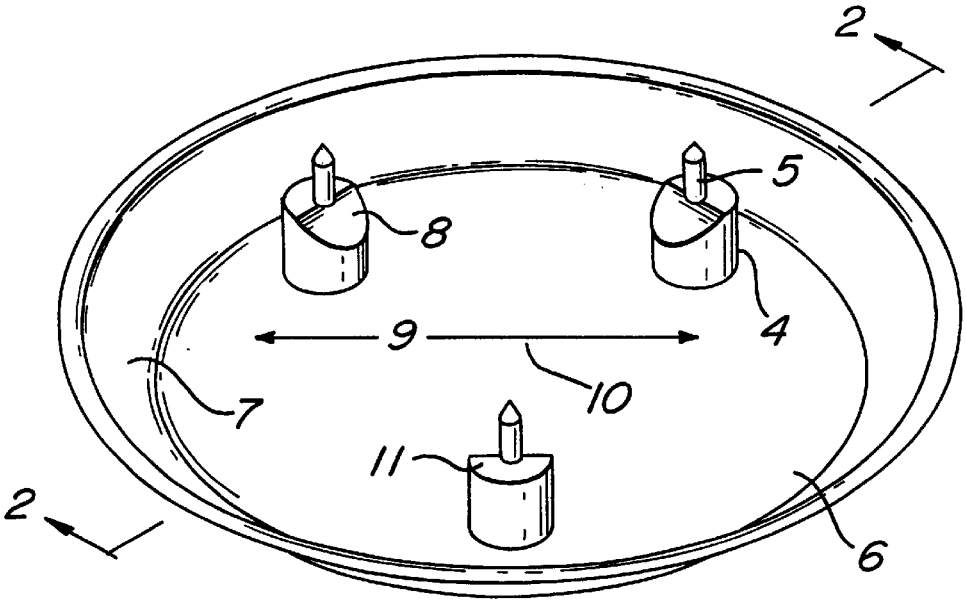
FIG. 1 is a perspective view of a pumpkin stand embodying the present invention.
Figure 2:
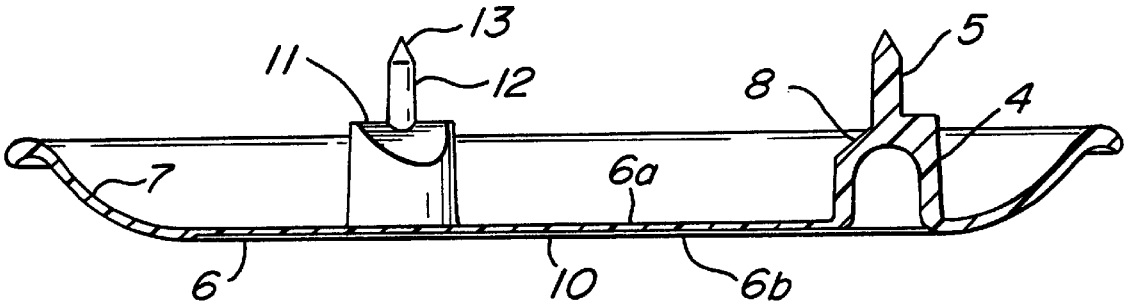
FIG. 2 is a cross-sectional view taken along line 2—2 of the pumpkin stand illustrated in FIG. 1.

Referring to FIG. 1, the stand S comprises a substantially circular dish 6 having an upturned peripheral flange 8. A plurality of pedestals 4 project from the top side 6*a* of the dish bottom 6 to the approximate height of the flange top. The pedestals have pins 5 for piercing and securing a pumpkin P when the pumpkin is positioned atop the pedestals 4 as illustrated in FIG. 3. In a preferred embodiment, only three pedestals are necessary, considering that the pumpkin will seat after it engages three pedestals.

The dish portion of the stand S consists of a circular flat bottom portion 6 and preferably an integral upturned peripheral flange 7. Two sizes of stands are desirable, a large for pumpkins having diameters in a range of about 10 inches to about 15 inches, and a small for pumpkins having diameters in a range of about 6 inches to about 10 inches. A large stand S has a preferred flat bottom diameter of approximately 7¾ inches with the upturned flange 7 extending around the bottom circular perimeter, forming a total dish diameter of approximately 10 inches. A small stand S has a total dish diameter of approximately 8 inches with a pedestal circle diameter of 5 inches. Preferably, small annular bosses are provided on the underside of the dish in alignment with each pedestal to limit any tendency of the dish to tip.

The pedestals 4 in the instant invention are preferably cylindrical and preferably have diameters and heights of about ¾ of an inch, thus providing seats 11 for a pumpkin approximately ¾ of an inch above the top side 6*a* of the dish bottom.

Each pedestal seat has a chamfer 8 inclined toward the center 10 of the dish bottom 6 at a preferable angle of 45° for forming a good fit with the curved lower periphery of a pumpkin.

It is also preferable that the pedestals 4 in this invention be located on an a pedestal circle 9 concentric with the dish center 10, and that the seats 11 on the pedestals be at about the same height as the top of the peripheral flange 7.

The preferred diameter of the circle on which the pedestals are centered should be on the order of about one half of the diameter of the largest pumpkin expected to be supported. For example: If the largest pumpkin to be carved has a diameter of 15 inches, then a pedestal circle diameter of 7 inches would be provided for a large size stand S. If smaller pumpkins are to be supported, then a pedestal circle diameter of 5 inches would be provided for a small size stand S. These diameters ensure that pins will penetrate small pumpkins at the bottom, and not the sides, while supporting larger pumpkins without their easily tipping over. The pedestals are located on radials disposed at 120° included angles from the center 10.

The pins 5 project from the seats 11 in a range of between about ⅛ inch to about 1 inch, and preferably about one-half inch. Desirably, the pins 5 consist of an elongate cylindrical shaft portion 12 terminating in a sharp point 13. However, when integrally molded, the pins may have vertically elongate ribs (not shown) that taper outwardly in a downward direction from their tips.

The stand S in FIG. 3 is preferably constructed of a durable lightweight water impermeable material, such as plastic, including but not limited to polyethylene, polypropylene, Melmac etc. It is preferably injection molded. Preferably, the pins 5 are integrally molded with the stand. A rubber skid proof undercoating may also be provided in the event that the disclosed support bosses (not shown) are not utilized.

The pumpkin stand described is best used as in FIG. 3 by impaling a pumpkin P on the upwardly projecting pins 5 and seating it on the pedestals 4. The pumpkin P may then be carved into a jack-o' lantern, capturing the juices and pumpkin debris in the dish portion 12 of the stand S below. The dish can then be emptied, with pumpkin still in place, by tilting the pumpkin and stand horizontally to allow the juices and debris to slide out. After carving the pumpkin P, the stand S makes an attractive base for display, while protecting an underlying surface from any matter that may further drop from the supported pumpkin. In addition, the stand S enables ambient air to circulate completely about the pumpkin, particularly its bottom, preventing moisture that might otherwise accelerate degradation of the pumpkin from contacting the bottom of the pumpkin.

If desired, the upturned peripheral flange 7 may be eliminated and the dish may be made smaller in diameter for placement in a larger separate dish having an upturned peripheral flange to provide for fluid collection, without requiring a monolithic structure as in the preferred embodiment.

While a preferred embodiment has been described in detail, various modifications, alterations and changes may be made without departing from the spirit or scope of the present invention as defined in the appended claims.

What is claimed is:

1. A pumpkin stand comprising:

a dish having a bottom and an upturned peripheral flange for containing liquids;

at least one upraised surface projecting upwardly from said bottom and formed integral therewith for supporting a pumpkin above said dish bottom;

at least one pin projecting upwardly above the upraised surface for piercing the bottom of the pumpkin to position it against movement with respect to the dish;

whereby a pumpkin can be placed on said upraised surface and carved while any juices discharged are collected in the dish.

2. A one-piece, molded plastic pumpkin stand comprising:

a receptacle for containing liquids, said receptacle having a bottom;

at least one upraised surface projecting upwardly from said bottom integral therewith for providing a seat for a bottom portion of a pumpkin to support the pumpkin above said receptacle;

at least one pin projecting upwardly above the seat for piercing the bottom of the pumpkin to position it against movement with respect to the receptacle;

whereby a pumpkin can be placed on the upraised surface and carved while any juices discharged are collected in the receptacle.

3. A pumpkin stand comprising:

a substantially circular dish having an upturned peripheral flange for containing liquids, said dish having a top side and a center;

a plurality of pedestals projecting upwardly from the topside, said pedestals being located equidistantly from the dish center, each pedestal having a chamfered surface inclined toward the center to provide a seat for a bottom portion of a pumpkin; and at least one pin projecting upwardly above each seat for piercing the bottom of the pumpkin to position it against movement with respect to the dish;

whereby a pumpkin can be placed on the pedestals and carved while any juices discharged are collected in the dish.

4. A pumpkin stand according to claim 3 where said pedestals are located on a circle concentric with said dish center, said circle having a diameter in a range of about 5 inches to about 7 inches.

5. A pumpkin stand according to claim 3 where each of said pedestal seats is located at about the same level as the top of said peripheral flange.

6. A pumpkin stand according to claim 3 where said chamfered surface is disposed at an angle of about 45° relative to the horizontal.

7. A pumpkin stand according to claim 3 where each pin projects upwardly about one-half inch above the surface of its seat.

8. A pumpkin stand comprising:

a base having a center and an upturned peripheral flange forming a receptacle for confining any liquids discharged from the pumpkin;

a plurality of pedestals projecting upwardly from the topside of the base, each pedestal having a chamfered surface inclined toward said center to provide a seat for the bottom portion of a pumpkin, and at least one pin projecting upwardly above each seat for piercing the bottom of the pumpkin to position it so as to preclude any movement with respect to the base;

whereby a pumpkin can be placed on the pedestals and carved or displayed.

9. A pumpkin stand according to claim 8 wherein said pedestals elevate the pumpkin bottom completely above an underlying surface to ensure complete ventilation of the pumpkin while on display.

* * * * *